US010342323B2

(12) United States Patent
Forutanpour

(10) Patent No.: US 10,342,323 B2
(45) Date of Patent: Jul. 9, 2019

(54) ERGONOMIC PHONE SUPPORT DEVICE

(71) Applicant: Babak Forutanpour, Carlsbad, CA (US)

(72) Inventor: Babak Forutanpour, Carlsbad, CA (US)

( * ) Notice: Subject to any disclaimer, the term of this patent is extended or adjusted under 35 U.S.C. 154(b) by 78 days.

(21) Appl. No.: 15/679,891

(22) Filed: Aug. 17, 2017

(65) Prior Publication Data

US 2019/0053613 A1 Feb. 21, 2019

(51) Int. Cl.
*A45F 5/00* (2006.01)
*A45F 5/10* (2006.01)

(52) U.S. Cl.
CPC ..... *A45F 5/10* (2013.01)

(58) Field of Classification Search
CPC ..... A45F 5/10; A45F 5/00; A45F 2200/05; A45F 2200/0508; A45F 2005/008; A45F 2200/0516; A45F 2200/0525; F16M 13/022
USPC ..... 294/145, 25, 137, 139, 150; 224/217, 224/218, 930; 206/320; 361/679.3, 361/679.56; 455/575.8; 248/682, 444, 248/450
See application file for complete search history.

(56) References Cited

U.S. PATENT DOCUMENTS 8,483,786 B2 * 7/2013 Ramies ..... B67B 7/16 455/550.1
8,690,210 B1 * 4/2014 May ..... A45F 5/00 224/217
8,740,270 B1 * 6/2014 Mizell ..... A45F 5/00 224/217
8,801,065 B1 * 8/2014 Jones ..... A45F 5/10 16/430
8,887,970 B2 * 11/2014 Tsai ..... G06F 1/1626 224/217
9,328,865 B2 * 5/2016 Briant ..... F16M 11/041
9,377,157 B1 * 6/2016 Kilgore ..... F16M 11/2064
9,388,939 B2 * 7/2016 Girault ..... G06F 1/1632
9,397,719 B1 * 7/2016 Schmidt ..... F16M 11/24
9,743,734 B2 * 8/2017 Bemis ..... A45C 13/1069
9,800,283 B2 * 10/2017 Schmidt ..... H04B 1/3877
9,861,182 B2 * 1/2018 Oberpriller ..... A45F 5/00
2007/0212931 A1 * 9/2007 Livingston ..... A45F 5/00 439/501
2012/0019016 A1 * 1/2012 Brisbin ..... A45F 5/00 294/137
2012/0118770 A1 * 5/2012 Valls ..... F16M 11/10 206/320

(Continued)

FOREIGN PATENT DOCUMENTS

DE 202013104161 U1 * 10/2013 ..... H04B 1/3888

*Primary Examiner* — Gabriela M Puig
(74) *Attorney, Agent, or Firm* — Donn K. Harms

(57) ABSTRACT

A support for a hand held phone or computing device is formed by a curved, elongated projection extending from a first end engagement with the phone or computing device to a distal end extending a distance past a portion of the perimeter edge of the phone or computing device. A curve formed on a first surface of the projection is adapted to contact the curved surface of a finger of a user placed against the perimeter edge of the phone or computing device to support it during use. The first end engagement can be formed as a permanent, rotational or removable engagement.

23 Claims, 7 Drawing Sheets

(56) References Cited

U.S. PATENT DOCUMENTS

| | | | | |
|---|---|---|---|---|
| 2012/0170211 | A1* | 7/2012 | Waller | A45F 5/102 361/679.56 |
| 2013/0062225 | A1* | 3/2013 | LaVaque | A45D 40/00 206/1.7 |
| 2013/0111711 | A1* | 5/2013 | Haase | A45F 5/00 24/307 |
| 2013/0161967 | A1* | 6/2013 | Jarrett | F16M 11/041 294/142 |
| 2013/0187020 | A1* | 7/2013 | Trotsky | F16M 11/10 248/309.3 |
| 2014/0077056 | A1* | 3/2014 | Ghosh | F16M 11/041 248/690 |
| 2014/0191099 | A1* | 7/2014 | Schwarz | F16M 13/005 248/309.1 |
| 2014/0191106 | A1* | 7/2014 | Le Gette | F16M 11/041 248/688 |
| 2014/0203154 | A1* | 7/2014 | Fan | F16M 11/041 248/205.5 |
| 2014/0285968 | A1* | 9/2014 | Budge | F16M 13/04 361/679.56 |
| 2015/0102197 | A1* | 4/2015 | Parameshwara | A47B 23/043 248/450 |
| 2016/0106190 | A1* | 4/2016 | Song | A45C 11/00 361/679.3 |
| 2016/0157592 | A1* | 6/2016 | Shmulevich | A45F 5/10 294/137 |
| 2017/0119118 | A1* | 5/2017 | Williams | A45F 5/00 |
| 2017/0152991 | A1* | 6/2017 | Cheng | A45F 5/10 |
| 2017/0223862 | A1* | 8/2017 | Justiss | F16M 11/10 |
| 2017/0366653 | A1* | 12/2017 | Roncetti | H04M 1/0281 |

* cited by examiner

ERGONOMIC PHONE SUPPORT DEVICE

FIELD OF THE INVENTION

The present device relates to a support device for a hand held computer such as a smartphone or the like. More particularly, it relates to a finger engageable support which is adapted for engagement on a mounting end to one of a smartphone casing or the cover surrounding it. So engaged, the device enables the user to safely tilt the phone backwards taking pressure off the small finger of the hand, while concurrently blocking the non ergonomic curved finger support of the smartphone or computing device.

BACKGROUND OF THE INVENTION

With the advent of smartphones, and ever wider employment of such devices by users, problems have developed due to the handling of such devices by users. While in years past, smartphones were not much bigger or heavier than flip phones and similar cell phones, due to the improvements in battery life and video interface technology, smartphones have evolved to more sizeable hand-held computers. Along with this increase and size and the enhanced graphics provided thereby, has come an increase in weight, as well as an increase in the grasping requirements of a user holding a modern smartphone device.

While cell phones in the past could be held on the shoulder or easily just held to the ear of the user, smartphones further provide a video display which gives the user an input device to operate the phone. Such requires the user to employ a finger of choice to touch icons, and to scroll depicted screens, and interact and input commands in other screen touching actions. Of course, when one hand is being employed to use a finger which must be precisely positioned or dragged across the smartphone display to use the phone, the other hand must hold the smartphone in a substantially fixed position.

Thus, a hand-holding of the smartphone is required to hold the perimeter edge of the phone to position the video display screen in front of the face of the user for reading. Additionally, as noted, the hand-holding of the smartphone must hold it steady for the precise touching and movements of the other hand interacting with the display to operate the phone.

While holding the phone between the thumb and fingers contacting opposing sides of the smartphone would seem like a common manner to hold such devices, such a grip does not always work well. One reason is the weight of such smartphones can easily fatigue the hand holding the smartphone tight enough to prevent it from falling from the muscular imparted compression between the thumb and fingers of the holding hand. As the hand tires of such gripping pressure, especially during extended periods of use, the muscles tend to relax, and such can cause the phone to easily slip for the grip of the user.

As a consequence, many smartphone users have adopted a non ergonomic grip on the phone, where the smallest finger on the hand, is curved underneath the bottom edge of the smartphone, to support the weight of the phone. While this hand configuration allows the user to grip the opposing sides less tightly, since the phone is resting on the small finger, holding the smartphone in this matter for long durations each day, while checking email, surfing the internet, looking at photos, etc., can cause compression as well as other injury to the small finger of the hand holding the smartphone in this manner.

Indeed, there is a physical malady being seen by physicians which has become known as "smartphone pinky finger" which is a term raising multiple results in an internet search. Such results in a permanent curvature of the small finger of the hand, forming the long term curved positioning while supporting the lower edge of a smartphone. In addition to the abnormal curvature caused by damaged ligaments of the finger, the skin and muscles covering the bones of the small finger are also known to suffer from compression injury and essentially visible "dents" in the finger, subsequent to long term use to support a smartphone thereon.

With smartphones getting ever larger as screen and battery technology improves, and with small pad computers being more widely employed instead of laptops, the physical problems suffered by the small finger of the hand supporting such devices for minutes or even hours of use every day, are just getting worse.

The forgoing examples of the hand and finger injuries resulting to the hands of smartphone holders and limitations related therewith, are intended to be illustrative and not exclusive, and they do not imply any limitations on the invention described and claimed herein. Various other limitations of the related art are known or will become apparent to those skilled in the art upon a reading and understanding of the specification below and the accompanying drawings.

SUMMARY OF THE INVENTION

The device and system herein disclosed and described provides a solution to the shortcomings in prior art and achieves the above noted objects through the provision of a device which may be engaged with a smartphone casing or smartphone cover, or can be formed as part of a smartphone cover as a unitary or permanently engaged structure. The device, as shown and described, herein, allows the user to safely tilt the smartphone backwards, during use against their hand while concurrently taking pressure off the small finger abutting the bottom surface of the smartphone and engaged with the device herein.

During experimentation various shapes of finger engageable components were tested, and over time a device having a curved projection, especially where it included three curved surface areas noted herein, was found to provide the optimum combination of both support for the small finger of the user in a comfortable ergonomic positioning in contact with the lower surface of the smartphone or case surrounding it. This shape was also found to provide a deterrent or blocking mechanism to deter or prevent the user from holding the smartphone using a curved small finger which over time damages ligaments and muscles of that finger.

By the use of the term smartphone herein, is meant any computing device having a touch screen which is small enough to be held in one hand while the opposite hand is employed to operate depicted icons, commands, and screens. Such may include small pad computers, electronic books or readers, or other similar devices which electronically depict graphic interfaces on a touch screen display. Of course the size of the hand of a user will also dictate the size of the hand-held device, and all such devices as would occur to those skilled in the art are anticipated to be within the scope of this invention.

The device herein, in a particularly preferred mode, is configured with a base having a curved projection extending from a first end connected with the base, to a distal end of the curved projection. The projection curves between the first end and distal end and has a first side within the recess formed by the curve adapted for contact against one side of the small finger of the hand of a user holding the smartphone or the like, to which the base of the device herein is engaged. While employment of a projection with a single curved surface extending between both side edges of the projection has shown to provide a significant advance and excellent finger contact to allow for the device to be supported by the rest of the hand of the user with a finger engaged in the projection, the inclusion of three different curved surfaces upon the projection was found to significantly enhance use. Providing three different curved surface areas increased both comfort and contact area between the projection and the finger of the user during use and is preferred.

The base of the device is substantially planar and adapted for engagement to a housing of the smartphone or a cover engaged with the housing. In one mode, an adhesive is used as a means for engagement of the base of the device to the housing or cover. Other modes, while not shown and not as easily employable, can use mechanical engagements of the base to the housing or cover. Alternatively, though not as preferred, the base can be formed as part of a casing cover engaged with the device to be held, but such is not as widely employable since the shape and diameter of such smartphones changes frequently, would require frequent mold changes and would be cost prohibitive in wide use.

In another mode of the device, the base has a first side surface adapted to engage with the smartphone housing or cover and has a second surface configured to form a rotational engagement with the first end of the curved projection. Such will allow for rotation of the curved projection from a deployed position extending past the perimeter edge of the housing or case engaged to it, to a retracted position where it does not extend past that perimeter. This rotating mode helps prevent the projection from catching on things during storage. Additionally, the rotational engagement between the curved projection and the base can be made removable, and the projection can be provided in a plurality of configurations in length and shape, from a kit of projections, all adapted at a first end to engage with the base.

Finally, the curved projection can be configured in various widths and curved configurations to accommodate the preferences of users either with a single curved surface area, or three curved surface areas as noted below as providing enhanced utility. Further, a fixed or rotational opposing curved portion may be provided to surround the finger of the user on two sides.

With respect to the above description, before explaining at least one preferred embodiment of the herein disclosed phone support invention in detail, it is to be understood that the invention is not limited in its application to the details of construction and to the arrangement of the components in the following description or illustrated in the drawings. The smartphone support invention herein described and shown is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other smartphone and pad computer, hand support devices and for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

It is an object of the present invention to provide a secure and comfortable phone support device which comfortably interfaces with the hand of a user.

It is an additional object of this invention to provide such a phone support device which encourages ergonomic holding of a smartphone or pad computer or the like, and which is easily mounted and adjusted.

These and other objects, features, and advantages of the present smartphone support invention, as well as the advantages thereof over existing prior art, which will become apparent from the description to follow, are accomplished by the improvements described in this specification and hereinafter described in the following detailed description which fully discloses the invention, but should not be considered as placing limitations thereon.

BRIEF DESCRIPTION OF DRAWING FIGURES

The accompanying drawings, which are incorporated herein and form a part of the specification, illustrate some, but not the only or exclusive examples of embodiments and/or features of the disclosed device. It is intended that the embodiments and figures disclosed herein are to be considered illustrative of the invention herein, rather than limiting in any fashion.

DETAILED DESCRIPTION OF THE INVENTION

Figure 1:
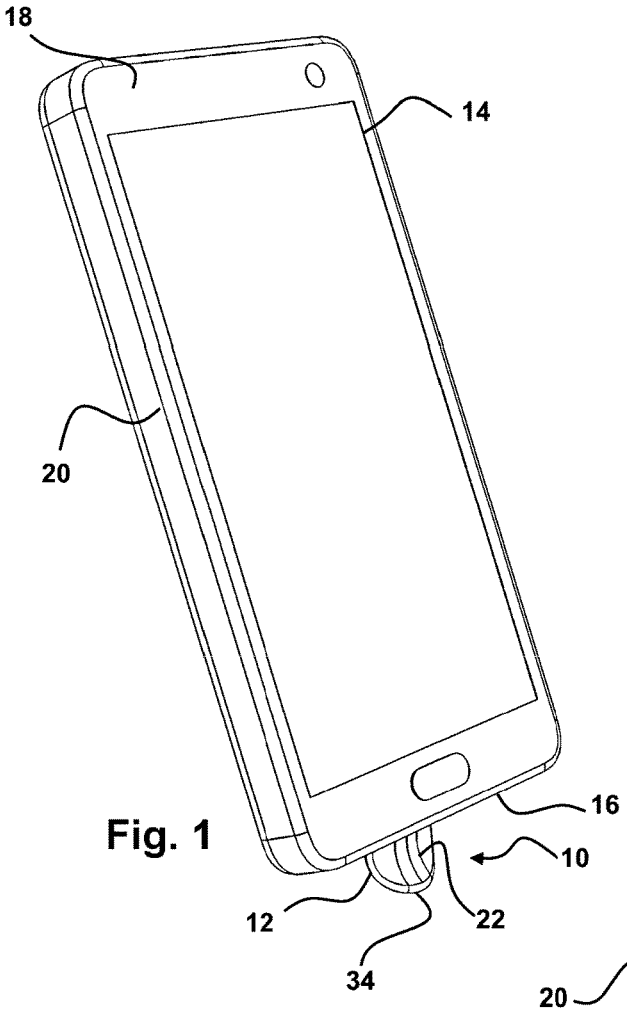
FIG. 1 depicts a perspective view of the projection of the device engaged centrally to a rear surface of a casing or cover for a smartphone and having the curved projection extending to a distal end a distance from the lower perimeter edge.

In this description, the directional prepositions of up, upwardly, down, downwardly, front, back, top, upper, bottom, lower, left, right and other such terms refer to the device as it is oriented and appears in the drawings and are used for convenience only and such are not intended to be limiting or to imply that the device has to be used or positioned in any particular orientation.

Now referring to drawings in FIGS. 1-16, wherein similar components are identified by like reference numerals, there can be seen in FIG. 1 a perspective view of the device 10 having a curved projection 12 which in an engaged position with a hand held computing device 14 such as a smartphone, and allowing a support for the computing device 14 by tilting in a contact with the hand of the user. The device 10 is preferably engaged to project from a central location of the lower edge 16 of the housing 18 of a computing device 14, if not covered, or such a central location of a cover 20 engaged around the housing 18.

Figure 10:
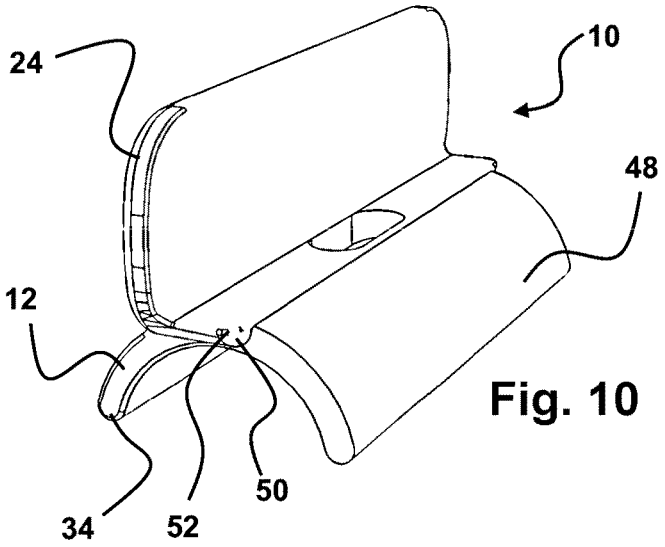
FIG. 10 depicts the device with an elongated projection extending from the base, and an elongated secondary curved member also extending from the base which may also be rotationally engaged at a first end.
Figure 11:
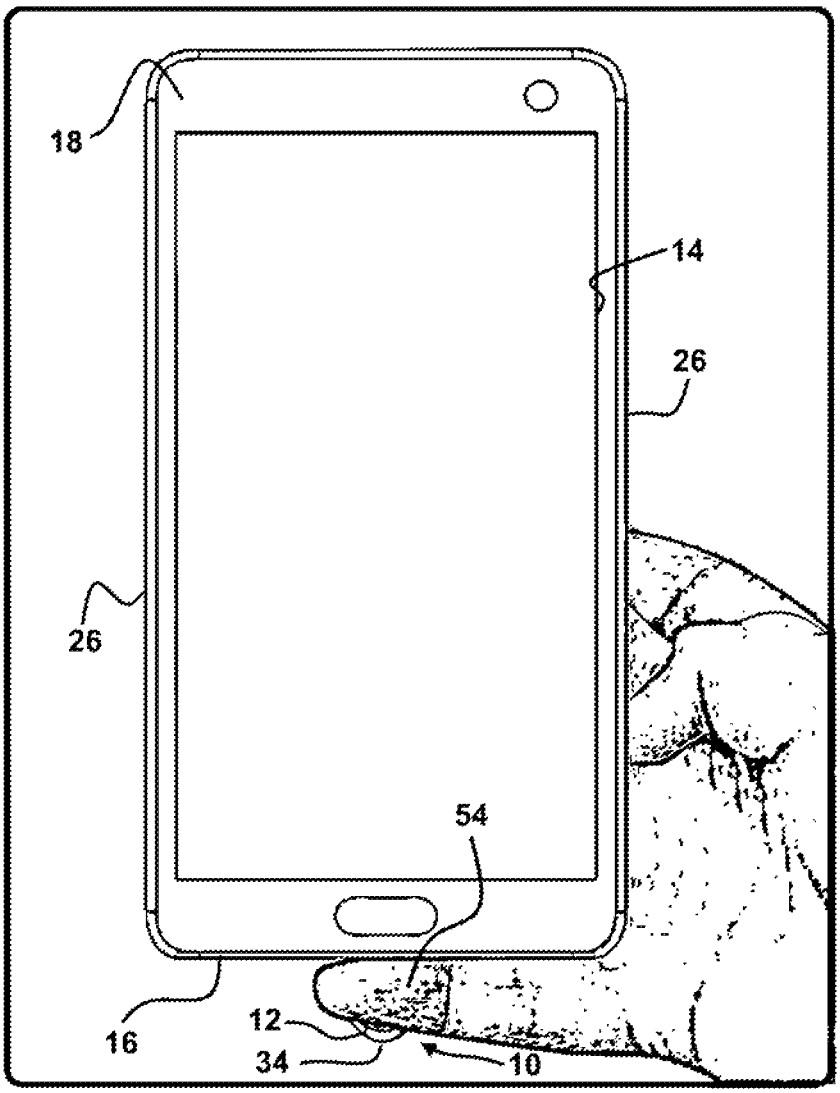
FIG. 11 depicts the device in an as-used positioning, with the substantially straight small finger of a user positioned within the recess of the curved projection, and underneath the lower edge of the smartphone which is held to the rear by the other fingers of the user.

In this position the device 10 enables the positioning of the smartphone or computing device 14 to the as-used positioning of FIG. 11, where the projection 12 discourages the ergonomically unsound habit of curving the small finger of the hand under the lower edge 16 by blocking it. Further, the curved projection 12 encourages the substantially straight positioning of the small finger under the lower edge 16 and within a recess 22 formed upon a first side of the curved projection 12, between the first end 32 of the curved projection 12 connected to the base 24 (FIGS. 4-10) and the opposite distal end 34 of the projection 12.

Figure 2:
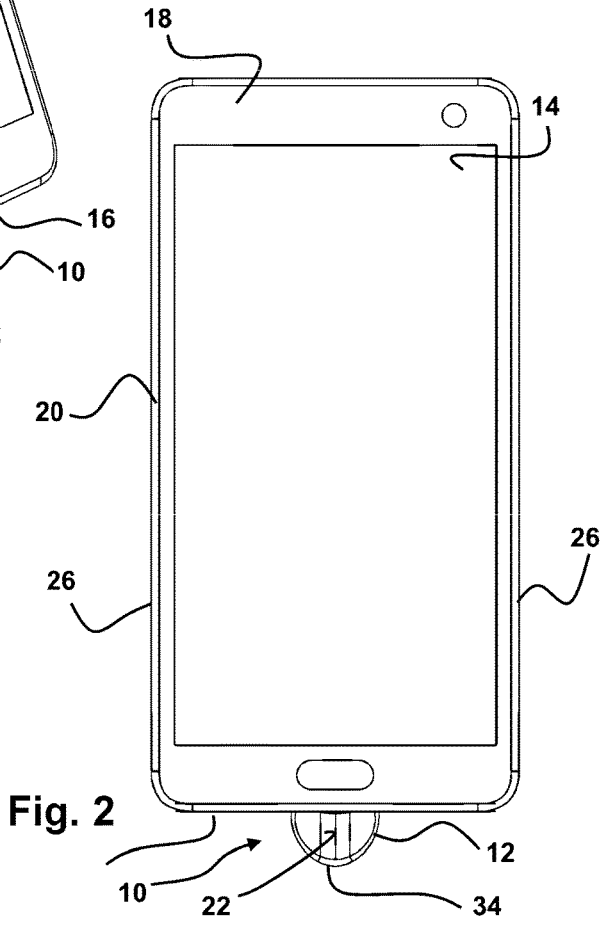
FIG. 2 depicts a top plan view of the device as in FIG. 1.

FIG. 2, better shows the projection 12 extending past the lower edge 16 in a central area of the lower edge 16 between the opposing side edges 26 of the housing 18 or if engaged, the cover 20.

Figure 3:
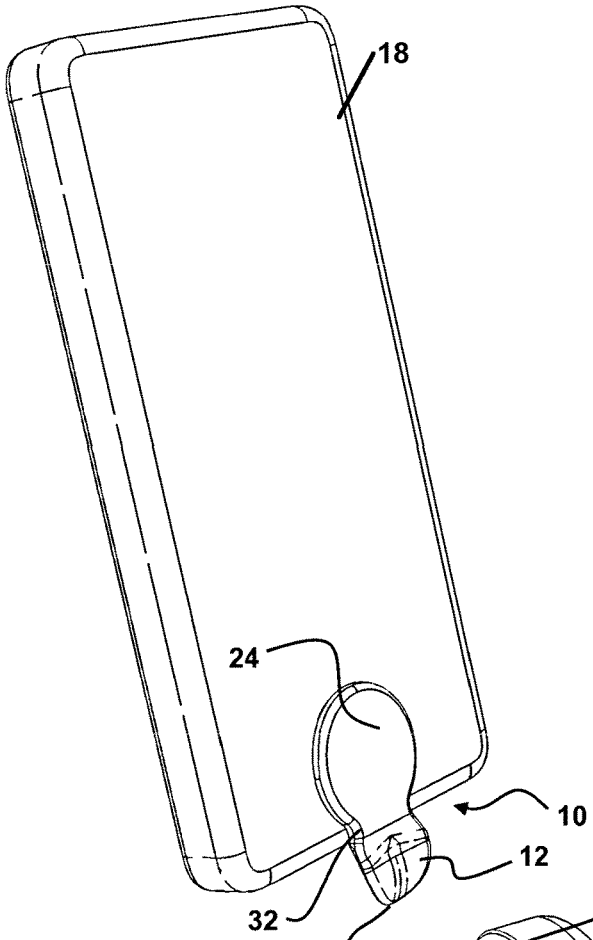
FIG. 3 shows a rear perspective view of the device as in FIGS. 1-2.

Shown in FIG. 3 is a rear perspective view of the device 10 engaged with one of a rear surface of the housing 18 or a cover 20 engaged on a housing 18. The base 24 is shown in an engagement of a first side of the housing 18 surface of the base 24 with this rear surface of the housing 18 or cover 20 if employed. The base 24 is substantially planar and is preferably formed from an elastic material such as plastic or other polymeric materials, which will allow the base 24 to bend or deform to accommodate a curved or other shape of the rear surface of a housing 18 or engaged cover 20. Additionally, the curved projection 12 may be formed of similar materials and may be textured for enhanced frictional engagement and may be covered with a layer of soft material such as silicone or fabric.

Figure 4:
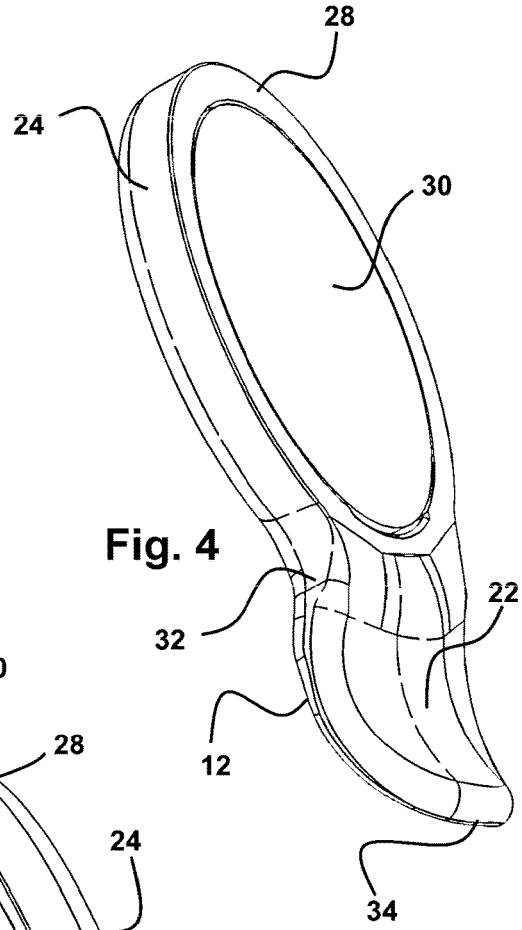
FIG. 4 shows the device having a substantially planar base portion to which a first end of the curved projection having a single or multiple curved surface areas is connected and showing the projection extending to a distal end.
Figure 5:
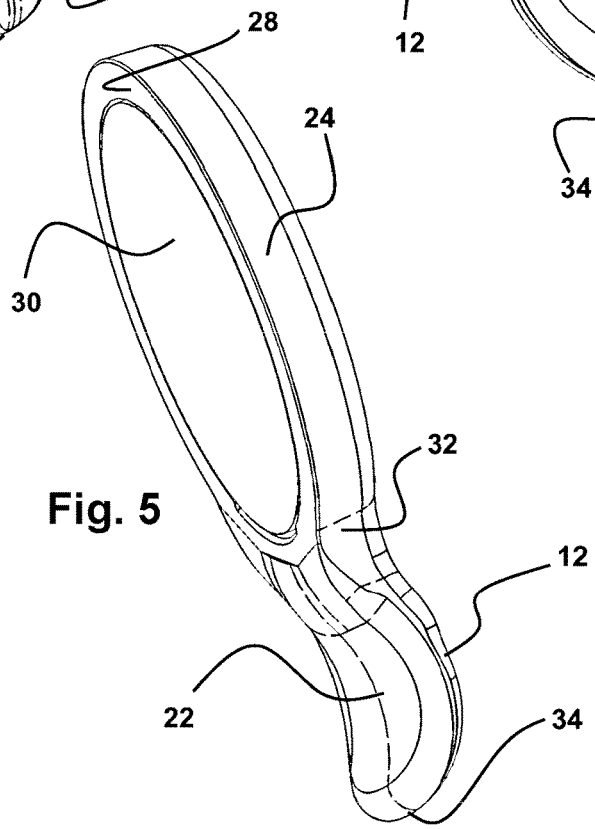
FIG. 5 depicts a second perspective view of the device of FIG. 4 and shows one of the downward curved surface areas extending from an elevated centrally located first curved surface area better shown in FIGS. 12-13.

In FIGS. 4-5 are depicted views of the base 24 having the curved projection 12 extending from a first end 32 connected to the base 24 to a distal end 34, and showing the recess 22 formed between the first end and distal end of the projection 12. Also shown is a connection to engage the first surface 28 with the rear surface of the housing 18 or cover 20 which in a preferred mode employs an adhesive 30 in an area on the first surface 28 as such a connection.

Figure 6:
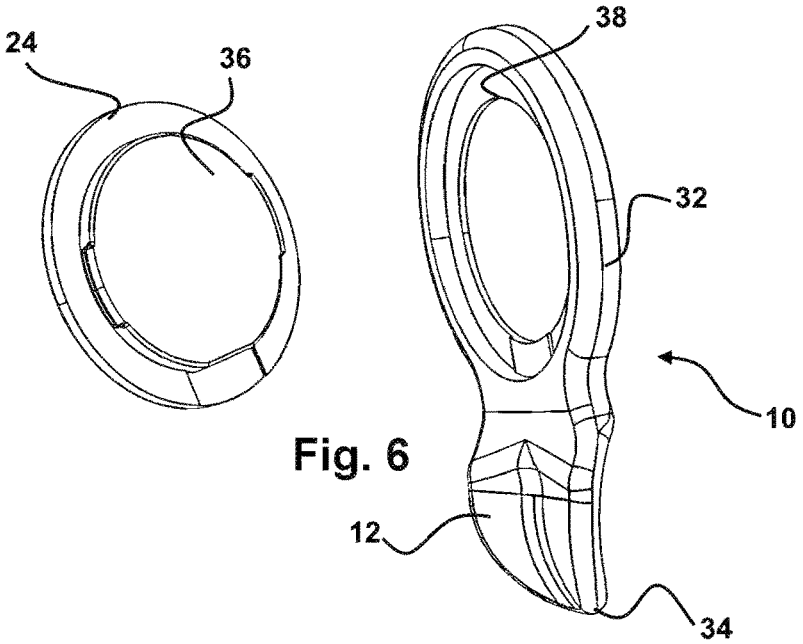
FIG. 6 depicts a mode of the device wherein the base is rotationally engaged with the first end of the projection and which may be removably engageable for allowing multiple projections to engage the same base.

In FIG. 6 is shown a mode of the device 10 showing engagement of mating connectors at the first end of the projection 12 and on the rear of the phone or the case covering it. In a mode of such shown in FIG. 6, the base 24 is configured for a rotational and/or removable engagement with the phone or phone cover with the base 24 connected with the first end 32 of the projection 12.

As shown, a first mating connector shown as a rotating or removable central portion 36 of the base 24, rotationally engages within a second mating connector shown as a recess 38 positioned at the first end 32 of the projection 14. This can be a snap fit where a first end 32 of the projection is flexible and elastic and allows it to stretch and engage around the projection 14, or could be accomplished using a bayonet type connection of projections from the central portion 36 which engage slots in the recess 38 at the first end 32, or other modes where a rotational engagement of the first end of the projection 12 is achieved.

As noted, this rotational engagement of the first end 32 of the projection 12 to the base 24, may be a removable engagement wherein the projection 12 can be removed and re-engaged. In a removable configuration, a kit of a plurality of projections 12 can be provided, each having respective first ends 32 configured for a removable engagement to a base 24 which glued, formed, or otherwise affixed to the rear surface of one of the housing 18 or cover 20. Such would allow the provision of multiple projections 12 having different lengths between the first end 32 and distal end 34, or different widths, and deeper or shallower recesses 22 formed between the first end 32 and distal end 34. Of course the recess 38 might also be formed on the base 24 affixed to the phone or cover and the engageable central portion 36 would be connected to the first end of the projection 12. Further, other mating connectors on both the first end of the projection 12 and the rear of the phone or cover can also be employed.

Figure 7:
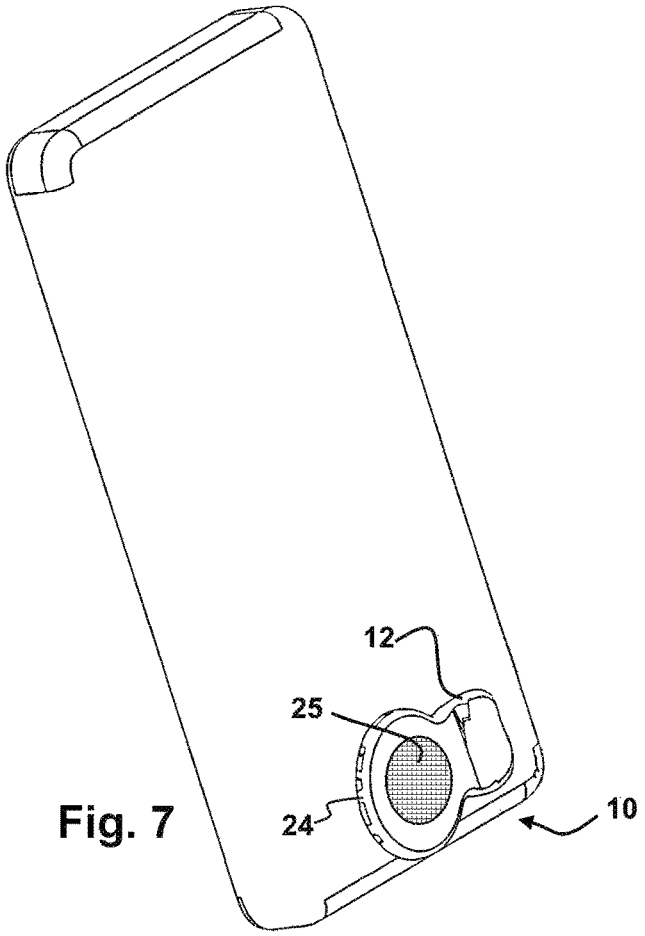
FIG. 7 shows the device as in FIG. 6, showing it rotated from a projecting position similar to that of FIG. 3, to a retracted position as in FIG. 7 in the rotational engagement of FIG. 6, and also shows a magnetic surface area which may be included in any of the modes of the device shown and described herein.

As noted, FIG. 7, shows the additional utility of the device 10, having a rotational engagement of the first end 32 of the projection 12 to a base 24 engaged to the rear surface of a housing 18 or cover 20. In FIG. 7 the device 10 is shown rotated from a projecting position of the projection 12 where the mid portion having the recess 22 and distal end 34 extend beyond the lower surface 16 similar to that of FIG. 3, to a retracted position of the projection 12, as in FIG. 7, where there is no extension of the projection 12 beyond the lower edge.

Also depicted in FIG. 7, is a magnetic surface area 25 which while shown in this depiction, may be included with all depicted and described modes of the device 10 herein. The magnetic surface area 25 is preferred to allow a computing device 14 having the device 10 herein operatively engaged, to be magnetically engaged with a magnetically attractive surface. By magnetically attractive surface is meant either another magnet, or a surface containing iron or nickle to which the magnetic surface area 25 will magnetically engage.

Figure 8:
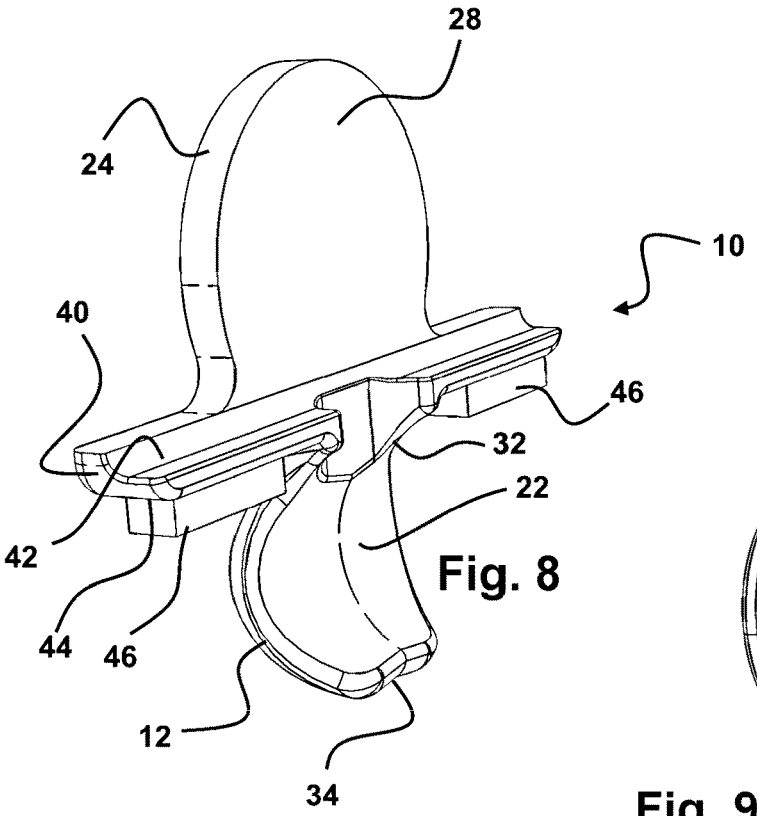
FIG. 8 shows another mode of the device having a base with a ledge having compressive padding thereon positioned to contact the finger of the user positioned within the recess of the curved projection.

Shown in FIG. 8, the device 10 may have a base 24 which has a ledge 40 which is configured to contact the lower edge 16 on a first side 42 opposite a second side 44. On the second side is positioned at least one pad 46 formed of compressible material such as open or closed cell foam, rubber, silicone, or another polymeric material which is formed to compress and pad the finger of the user from the weight of the lower edge 16 of the computing device 14. As depicted a gap communicates through a central portion of the ledge 40 for a socket of the computing device 14 such as a USB socket in a smartphone. In such a configuration a plurality of pads 46 are positioned on the second side 44 of the ledge 40.

Figure 9:
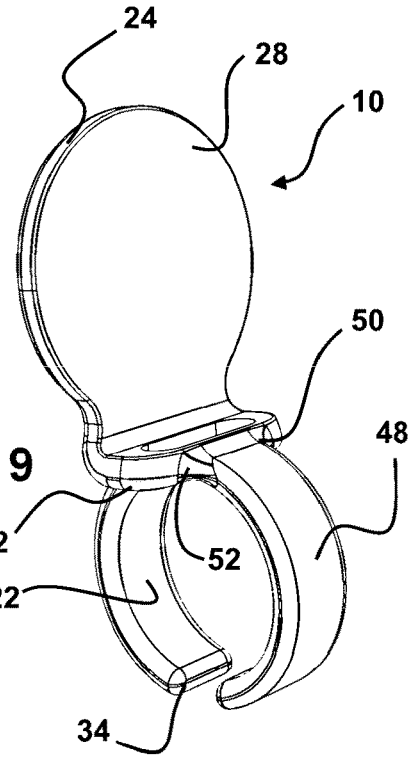
FIG. 9 shows the device in a configuration where the projection extends from a connection to the base, and a secondary curved member mirroring the shape of the curved projection also extends from the base in a fixed or rotational engagement thereto.

In FIG. 9, there is shown a configuration of the device 10 where the projection 12 extends from a first end 32 connected to the base 24. Also shown is a secondary curved member 48 which extends to a distal end from a connection end engaged with the base 24. In a mode allowing for rotation of the secondary curved member 48 out of the way, it may be in a rotational engagement 50 such as on an axle 52 connecting the first end to the base 24.

Shown in FIG. 10, the device with may have the projection 12 extending from a first end engagement to the base 24, which is elongated. This elongated projection 12 may also be in a rotational engagement 50 to the base 24 similar to that of FIG. 9.

Finally, FIG. 11 depicts the device 10 operatively engaged with the computing device 14, in an as-used positioning. In such a positioning, the centrally positioned projection positions the recess 22 adjacent to or in contact with a substantially straightened small finger 54 of a user. The lower edge 16 of either the housing 18 or cover 20 on the housing 20 encouraged to be positioned on the substantially straightened small finger 54 and blocks a curved small finger 54 configuration for such support by the central positioning. So positioned the computing device is supported on the rest of the fingers of the hand, and rotation or flipping of the computing device 14 or smartphone over the top of the fingers and hand is prevented by contact of the surface of the projection 12 in the recess 22 against the small finger 54 of the user.

Figure 12:
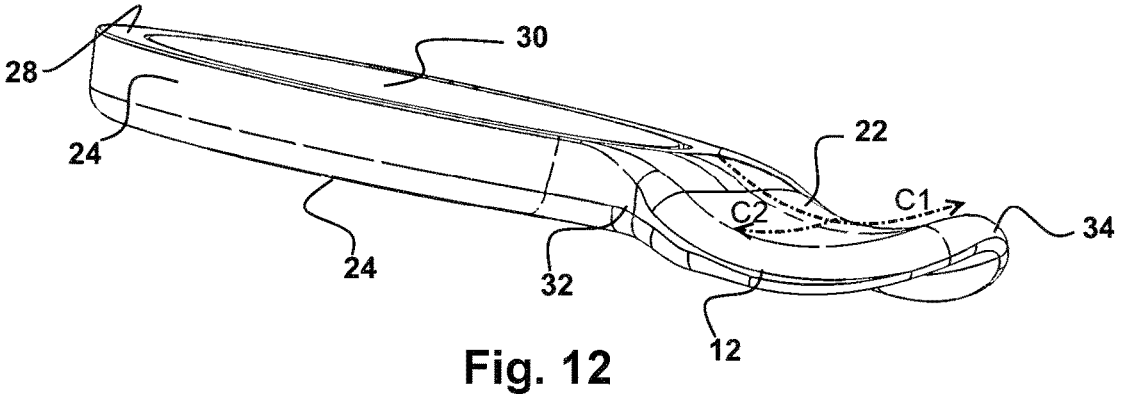
FIG. 12 shows a perspective view of the projection portion of the device, illustrating a configuration having three curved areas configured for comfortable and increased contact against the skin and finger of a left or right-handed user.
Figure 13:
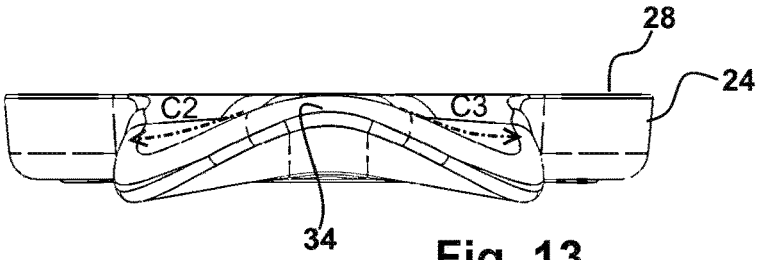
FIG. 13 is a view of the distal end of the projection showing the second curved surface area and third curved surface area extending toward respective side edges of the projection from the central portion of the projection having a first curved surface area elevated above the other two.

In FIGS. 12-13 is shown views of the device herein in a particularly preferred mode which includes three different curved surface areas. As shown in FIG. 12, a first curved surface area C1 runs along a center area of the projection 12 between the first end 32 connected at the base 24 and the distal end 32 of the projection. The elevation of this first curved surface area C1 is slightly above the surface of the recess 22, adjacent the side edges of the projection 12. A second curved surface area C2, extends from the first curved surface area C1 to a first respective edge of the projection 12. A third curved surface area C3 is a mirror shape of the second curved surface area C2 and extends from the first curved surface area C1 to the opposing side edge of the projection.

The three curved surface areas were developed during experimentation to provide additional comfort during use by either right handed or left-handed users. It was found that a first curved surface area C1 could be provided which just extended to the side edges and formed a "C" shape to the projection 12 and would provide the support for the small finger of the user when balancing the computing device 14 as in FIG. 11. However, it was unexpectedly found that the side edges of the projection 12 tended to dig into the skin of the finger of the user.

Through experimentation with many shapes, it was found that forming an opposing mirrored second curved surface area C2 and third curved surface area C3, both of which curve the opposing two side edges of the curved member downward and from the higher central area of the first curved surface area C1, form angled flaps which provide a much more comfortable engagement and increased the area of contact between the projection 12 and the finger providing better contact and support for balance.

By forming mirrored second and third curved surface areas C2 and C3, to form the angled side flaps, the device 10 also better accommodates holding by either left handed users or right-handed users since the opposing mirrored second and third curved surface areas of C2 and C3 form the angled flaps for a comfortable and increased surface contact with either hand of the user. As such, forming the projection 12 similar to the shape and contour of a duck bill with a first curved surface area C1 running centrally between said first end and said distal end 34, which is elevated and in-between the second curved surface area C2 and third curved surface area C3, to thereby form respective first and second angled flaps on the opposing sides of the projection 12, is an especially preferred mode of the device 10 herein. These flaps angle downward from the higher elevated first curved surface area C1 when viewed from the distal end such as in FIG. 13.

Figure 13A:
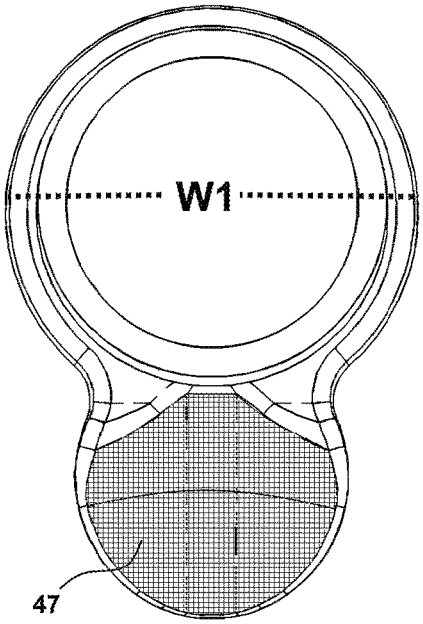
FIG. 13A depicts a rear view of the device showing a width W1, which was determined after much experimentation to yield improved comfort for an overlying ring finger during holding of a phone as shown in FIG. 11.

Shown in FIG. 13A is a rear view of the device 10 showing a width W1, which has been determined after much experimentation to yield improved comfort for an overlying ring finger during holding of a phone as shown in FIG. 11. This width W1 was shown to provide enhanced comfort to the curved ring finger of the user traversing over the device 10. Currently, a width W1 in a range between 20 mm-30 mm was found to provide enhanced comfort. A most favored range for width W1 was found to be between 24 mm-26 mm which was found to yield the most comfort to users curving their ring finger over the base 24.

Figure 13B:
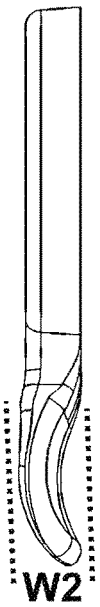
FIG. 13B depicts a side view of the device herein, showing a width W2 of the curved projection determined after experimentation to yield enhanced comfort to the user when the curved projection is in operative contact with the small finger of the user holding a phone as in FIG. 11.

FIG. 13B depicts a side view of the device herein, showing a width W2 of the curved projection 12 determined after experimentation to yield enhanced comfort to the user when the curved projection 12 in operative contact with the exterior surface of the small finger of the user holding a phone as in FIG. 11. A width W2 in a range of 3 mm-9 mm worked well and an especially preferred width W2 yielding the most comfort to the user while supporting the phone was in a range between 5 mm-7 mm. Additionally shown is an optional electrostatic flocking or coating material 47 which has a soft, velvet like feel.

Figure 14:
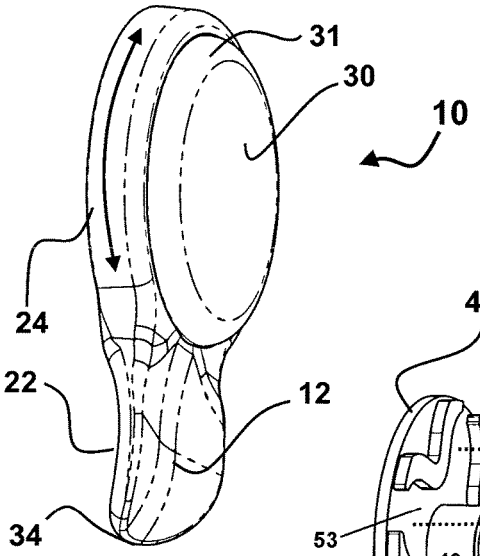
FIGS. 14-16 depict another mode of the device similar to that of FIGS. 6-7 but including a plurality of magnets which provide four removably fixed positions for the curved projection and provide a sonic feedback when rotating.
Figure 15:
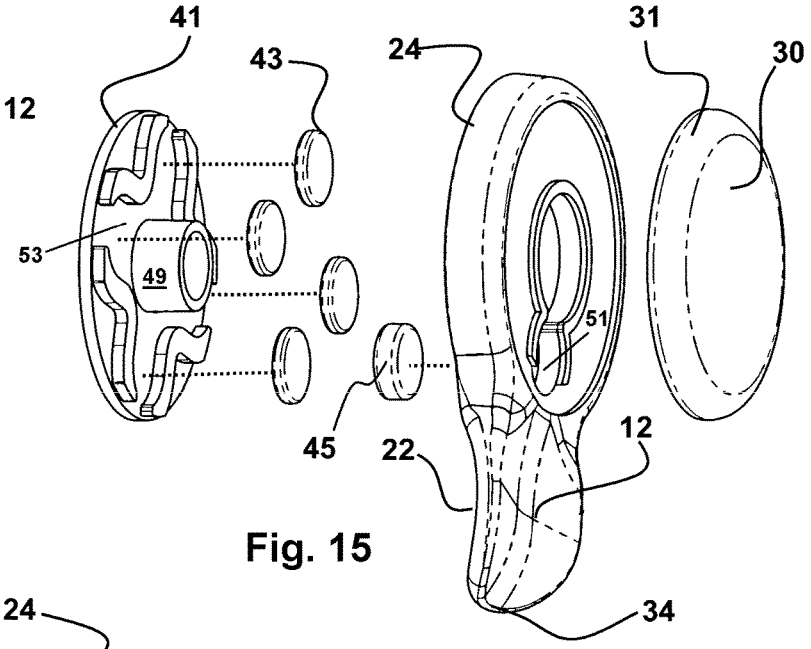
Figure 16:
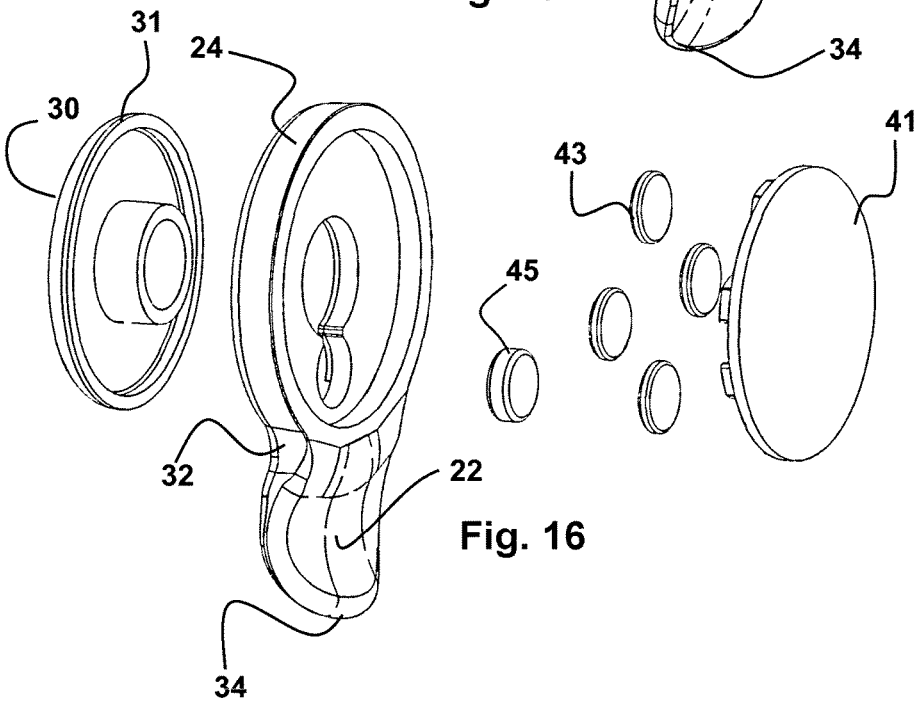

Shown in FIGS. 14-16 is another rotating mode of the device 10 herein. As shown, the device 10 is similar to that of FIGS. 6-7 but includes a plurality of secondary magnets 43 each in a respective slot 53 which provide four removably fixed positions for the curved projection 12. This also provides for an auditory or sonic signal or feedback, when rotating between those positions. As shown, the base 24 engaged with the curved projection 12 will rotate around an axle 49 of a baseplate 41 which has the adhesive 30 or similar means of engagement to a phone case. During rotation a first magnet 45 located in an opening 51 in the base 24 has magnetic poles which are the opposite of, and positioned to be attracted to, each of the secondary magnets 43, positioned in a respective slot 53 in the baseplate 41. This baseplate 41 has an axle 49 which communicates operatively through the base 24 to a connection with the baseplate 31.

The first magnet 45 and the secondary magnets 43 all are positioned such that there is a North/South attraction when the first magnet 45 aligns with a secondary magnet 53. This forms a magnetic coupling at each of the four slots 43 where the secondary magnets 43 are positioned to hold the base 24 and connected rotating curved projection 12 in place, until the user imparts sufficient force to overcome the magnetic coupling, and to rotate the base 24 and curved projection 12 to a next magnetic coupling between the first magnet 45 and a secondary magnet 43.

Additionally and preferred, during each magnetic coupling, an auditory or sonic signal occurs each time the first magnet 45 and secondary magnet 43 align. This "click" or similar sonic or auditory signal is generated by at least one of the two magnets 43 and 45, translating slightly in their respective slot 53 or opening 51 when the are magneticlly drawn toward a contact with each other or the end of the slot 53 or opening 51. Making the slot 53 longer than the width of the secondary magnet 42 and the first magnet 45 shorter than the length of the opening 51, allows this translation or sliding during achievement of a magnetic coupling, the resulting generation of the auditory signal upon contact of the magnets with each other, or the end of the sliding engagement. This sonic or auditory signal is preferred because it allows the user to rotate the curved projection 12 and hear the auditory signal of the aligned magnets translating to contact each other or the end of the sliding engagement, and thereby signifying alignment of the magnets 43 and 45 in a magnetic coupling and proper position without looking at the device.

It should be noted than any of the different depicted and described configurations and components can be employed with any other configuration or component shown and described as part of the device herein. Additionally, while the present invention has been described herein with reference to particular embodiments thereof and steps in the method of production, a latitude of modifications, various changes and substitutions are intended in the foregoing disclosures, it will be appreciated that in some instance some features, or configurations, of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A support apparatus for a hand held phone, comprising:

an elongated projection extending between a first end and a distal end;

said elongated projection formed in a curve extending between said first end and said distal end;

said curve defining a recess on a first side surface of said elongated projection in-between said first end and said distal end;

said first end of said elongated projection in an engagement with one of a surface of said phone or a surface of a cover engaged upon said phone; and said engagement positioning said recess adjacent a portion of a perimeter edge of said phone, whereby said first side surface of said elongated projection within said recess, forms a contact against an exterior of a finger of a user positioned in a communication with said perimeter edge of said phone; additionally comprising said recess on said first side surface of said elongated projection having a first curved surface area running centrally between said first end and said distal end; a second curved surface area running along a first side of said elongated projection; a third curved surface area running along a second side of said elongated projection opposite said first side; said second curved surface area forming a first angled flap portion on said first side of said elongated projection; and said third curved surface area forming a second angled flap portion upon said second side of said elongated projection.

2. The support apparatus of claim 1, additionally comprising:

a base connected to said first end of said elongated projection; and a first side of said base forming said engagement with said one of said surface of said phone or said surface of said cover engaged upon said phone.

3. The support apparatus of claim 2, wherein said engagement is formed by an adhesive positioned upon said first side of said base.

4. The support apparatus of claim 3, wherein said engagement is formed by a first mating connector engaged with said base connected to said first end of said elongated projection, said first mating connector engaging with a second mating connector positioned upon said surface of said phone or said surface of said cover engaged upon said phone.

5. The support apparatus of claim 4 additionally comprising:

said engagement of said first mating connector and said second mating connector is rotational.

6. The support apparatus of claim 4 additionally comprising:

said engagement of said first mating connector with said second mating connector forms a removable engagement therebetween.

7. The support apparatus of claim 2, wherein said engagement is formed by a first mating connector engaged with said base connected to said first end of said elongated projection, said first mating connector engaging with a second mating connector positioned upon said surface of said phone or said surface of said cover engaged upon said phone.

8. The support apparatus of claim 7 additionally comprising:

said engagement of said first mating connector and said second mating connector is rotational.

9. The support apparatus of claim 8 additionally comprising:

said rotational engagement having four removably fixed positions; and each of said removably fixed positions formed by a magnetic coupling between a first magnet connected to and rotating with said elongated projection, and one of a plurality of second magnets in fixed positions.

10. The support apparatus of claim 9 additionally comprising:

at least one of said first magnet or said plurality of second magnets being slidingly positioned; and a sliding of said first magnet or a said second magnet generating an auditory signal during formation of each said magnetic coupling.

11. The support apparatus of claim 7 additionally comprising:

said engagement of said first mating connector with said second mating connector forms a removable engagement therebetween.

12. The support apparatus of claim 2 additionally comprising:

a magnetic surface positioned on said base.

13. The support apparatus of claim 2 additionally comprising:

said base having a width between 24 mm-26 mm.

14. The support apparatus of claim 13 additionally comprising:

said curved projection having a width between 5 mm-7 mm.

15. The support apparatus of claim 2 additionally comprising:

said curved projection having a width between 5 mm-7 mm.

16. The support apparatus of claim 2, additionally comprising:

an electrostatic flocking positioned on an exterior surface of said elongated projection.

17. The support apparatus of claim 1, wherein said engagement is formed by a first mating connector engaged with said first end of said elongated projection, said first mating connector engaging with a second mating connector positioned upon said surface of said phone or said surface of said cover engaged upon said phone.

18. The support apparatus of claim 17 additionally comprising:

said engagement of said first mating connector with said second mating connector is rotational.

19. The support apparatus of claim 18 additionally comprising:

said rotational engagement having four removably fixed positions; and each of said removably fixed positions formed by a magnetic coupling between a first magnet connected to and rotating with said elongated projection, and one of a plurality of second magnets in fixed positions.

20. The support apparatus of claim 19 additionally comprising:

at least one of said first magnet or said plurality of second magnets being slidingly positioned; and a sliding of said first magnet or a said second magnet generating an auditory signal during formation of each said magnetic coupling.

21. The support apparatus of claim 17 additionally comprising:

said engagement of said first mating connector with said second mating connector forms a removable engagement therebetween.

22. The support apparatus of claim 1 additionally comprising:

a magnetic surface positioned at or adjacent said first end of said elongated projection.

23. A support apparatus for a hand held phone, comprising: an elongated projection extending between a first end and a distal end; said elongated projection formed in a curve extending between said first end and said distal end; said curve defining a recess on a first side surface of said elongated projection in-between said first end and said distal end; said first end of said elongated projection in an engagement with one of a surface of said phone or a surface of a cover engaged upon said phone; and said engagement positioning said recess adjacent a portion of a perimeter edge of said phone, whereby said first side surface of said elongated projection within said recess, forms a contact against an exterior of a finger of a user positioned in a communication with said perimeter edge of said phone; additionally comprising:

an electrostatic flocking positioned on an exterior surface of said elongated projection.

* * * * *